US008814073B2

(12) United States Patent
Barber

(10) Patent No.: US 8,814,073 B2
(45) Date of Patent: Aug. 26, 2014

(54) TOOTH CONSTRUCTION

(75) Inventor: Richard Barber, Alfreton (GB)

(73) Assignee: MMD Design & Consultancy Limited, Somercotes (GB)

( * ) Notice: Subject to any disclaimer, the term of this patent is extended or adjusted under 35 U.S.C. 154(b) by 494 days.

(21) Appl. No.: 13/202,126

(22) PCT Filed: Feb. 16, 2010

(86) PCT No.: PCT/GB2010/050252

§ 371 (c)(1),
(2), (4) Date: Sep. 29, 2011

(87) PCT Pub. No.: WO2010/094951

PCT Pub. Date: Aug. 26, 2010

(65) Prior Publication Data

US 2012/0012688 A1 Jan. 19, 2012

(30) Foreign Application Priority Data

Feb. 19, 2009 (GB) ..... 0902729.3

(51) Int. Cl.
*B02C 13/28* (2006.01)
*B02C 4/30* (2006.01)

(52) U.S. Cl.
CPC ..... *B02C 4/30* (2013.01)
USPC ..... 241/189.1; 241/194

(58) Field of Classification Search
USPC ..... 241/294, 295, 189.2, 197, 189.1
See application file for complete search history.

(56) References Cited

FOREIGN PATENT DOCUMENTS

| | | | |
|---|---|---|---|
| EP | 0167178 | A2 | 1/1986 |
| WO | WO-96/29149 | A1 | 9/1996 |
| WO | WO-98/58739 | A1 | 12/1998 |
| WO | WO-03/006165 | A1 | 1/2003 |
| WO | WO-2005/046875 | A1 | 5/2005 |

OTHER PUBLICATIONS

Kopacz, Ireneusz, "International Search Report", for PCT/GB2010/050252, as mailed Nov. 3, 2010, 5 pages.

*Primary Examiner* — Mark Rosenbaum
(74) *Attorney, Agent, or Firm* — Winstead PC

(57) ABSTRACT

A tooth construction for a mineral breaker, the tooth construction including a tooth shaped support body covered by a shell on which is mounted a breaking tip formation to define the outer shape of the tooth construction; the support body having a front face, an opposed rear face, and a pair of opposed side faces extending therebetween; the shell being composed of a cover formation defining a front wall, opposed side walls, and a top wall overlying and seated in face to face contact with respective front, side and top faces of the support body; the breaking tip formation comprising a pick formation presenting a rear surface in face to face contact with and secured upon the front wall of the cover so as to project forwardly therefrom and a top formation extending rearwardly of the pick formation and presenting a lower surface in face to face contact with and secured upon the top wall of the cover.

21 Claims, 5 Drawing Sheets

TOOTH CONSTRUCTION

The present invention relates to a tooth construction. The present invention relates in particular, but not exclusively to a tooth construction for a mineral breaker.

The present invention also relates to a method of constructing a drum assembly for a mineral breaker and to a drum assembly per se.

The present invention is concerned primarily, but not exclusively, with the type of mineral breaker disclosed in European patent 0167178.

With this type of mineral breaker, mineral lumps are broken down by gripping the lumps and applying tensile forces to cause the lump to break by a snapping action.

With this type of mineral breaker, each tooth is repeatedly exposed to large breaking forces applied, on the one hand, onto the front of the tooth and then, on the other hand, onto the rear of the tooth.

In order to enable each tooth to withstand the breaking forces without snapping it is desirable to construct each tooth so as to have a core formed of a ductile metal which is covered with a tooth shell of a wear resistant material, which in itself can be relatively brittle. In order to be capable of breaking particularly hard minerals, such as for example granite, it is necessary to be able to transmit, from the drive shaft, relatively large forces.

These large forces, in turn, exacerbate the securance of a tooth shell on the tooth core or horn and also require the core or horn construction to be robust enough to transmit the relatively high forces required.

International patent application WO2005/046875 describes a tooth construction for a mineral breaker, the tooth construction including a tooth shaped support core or horn formation covered by a shell which defines generally the outer shape of the tooth construction, the shell being composed of a plurality of covers which are fixedly secured to one another and/or to the support body by welding, onto a forward face of which shell a breaking tip member is secured to define a tooth construction.

According to one aspect of the present invention there is provided a tooth construction, for example for a mineral breaker, the tooth construction including a shell for and mountable upon a tooth shaped support body and a breaking tip formation mountable on the shell which together define generally the outer shape of the tooth construction; the support body having a front face, an opposed rear face, a pair of opposed side faces extending therebetween, and a top face; the shell being composed of a cover formation defining a front wall, opposed side walls, and a top wall overlying and configured to be seated in use in face to face contact with respective front, side and top faces of the support body; the breaking tip formation comprising a pick formation presenting a rear surface configured to be seated in use in face to face contact with the front wall of the cover so as to project forwardly therefrom and a top formation extending rearwardly of the pick formation and presenting a lower surface configured to be seated in use in face to face contact with the top wall of the cover.

To assemble the tooth construction, the front wall, opposed side walls, and top wall of the cover formation are mounted upon and preferably fixedly secured to and for example welded to the respective underlying faces of the support body. The respective rear surface and lower surface of the respective portions of the breaking tip formation are mounted upon and preferably fixedly secured to and for example welded to the respective outer surfaces of the forward and top wall of the cover formation. The whole assembly together defines a complete tooth construction.

In contrast with many prior art systems, the breaking tip formation in accordance with the invention is not a simple, for example conical, pick, but extends over the top face of the cover preferably for at least a substantial portion, comprising at least a major part of and for example for substantially all of, the length and/or width of the top face of the cover. The breaking tip formation includes a pick formation and such a rearwardly extending top formation. This means that the most superior and wear-resistant materials need only be used on the breaking tip formation, which therefore provides mechanical protection both on the front face and along the exposed top surface of the assembled tooth.

In typical use, both the breaking tip formation and the cover are consumable wear components. The tip formation, comprising a forward facing pick and a top surface of the tooth, is subject to the most severe wear regime. This design may offer more economical use of the higher grade material necessary for these two locations.

The pick formation and rearwardly extending top formation of the breaking tip formation may be integrally formed as a one-piece monolith, for example as a one-piece casting. Alternatively, for example to accommodate different wear regimes at the two parts of the breaking tip formation, the breaking tip formation may comprise a pick formation and rearwardly extending top formation which are separately formed, for example of different materials, and joined together. In this case, the breaking tip formation is preferably formed as a two-piece construction, in which each of the pick formation and the extending top formation is integrally formed as a one-piece monolith, for example a one-piece casting.

Thus, specifically selected higher grade wear materials may be used for the two locations subject to the most severe wear regime. Alternative materials may be used for the shell. Typically, the life of the shell cover may be two to three tips.

A further advantage of the rearward extension of the breaking tip formation is that a much greater surface area is presented between tip and cover, providing a much greater area for welding of the two components together, and improving structural integrity of the resultant assembled tooth formation.

In one possible embodiment the shell cover formation comprises a plurality of cover elements comprising at least separate front and top covers and paired side covers which are fixedly securable to one another and/or to the support body, for example by welding, to define the said front wall, opposed side walls, and a top wall of a shell cover or cap for a unitary tooth construction.

In an alternative, preferred embodiment the shell comprises a cover formation integrally including as a single integral formation, and for example as a unitary casting, at least the said front wall, opposed side walls, and a top wall of a shell cover or cap for a unitary tooth construction.

Preferably the side and front walls each have at least one aperture formed therein to expose the underlying corresponding face of the support body when the shell is in place thereon. This enables the walls of the apertures to be welded to the exposed underlying faces of the support body in the assembled structure.

In either case, a breaking tip formation as above described is mounted upon, and for example welded to, the front wall and top wall so that a pick formation projects forwardly from the front wall, and a top formation extends rearwardly of the pick formation over at least a major part of, and preferably substantially all of, the top wall surface. The tip formation thus covers areas of heaviest wear. Optionally, additionally, further consumable wear plates may provided to be fixed to other exposed surfaces of the cover. For example, a rear wear plate may be provided to be fixedly mounted, for example by welding, to the rear of the cover and/or the rear face of the support body. Additionally or alternatively a forward wear plate may be provided to be fixedly mounted, for example by welding, to the front wall of the cover and/or forward face of the support body to the extent that the front wall and/or forward face is not already covered by the pick formation of the breaking tip.

In typical construction, a top face of the tooth support body or horn is likely to have a curved circumferential profile. In prior art systems including a cover, the top wall of the cover might typically have an equivalent curved shape which followed the curve of the horn. Failure to do this, at least at an inner surface, might leave the cover mechanically unsupported over a portion of the length of the horn. In practice, the mating of two curves may be hard to achieve.

In a preferred embodiment of the present invention, particularly suited to the preferred case where the shell comprises a cover formation which is integrally formed for example as a unitary casting, a top surface of the cover lying outermost when assembled (that is, the surface opposed to the surface in face to face engagement with the top face of the support body) comprises a plurality of planar surface portions. These planar surface portions may conveniently be disposed at an angle to each other so as to generally follow the curve of the top face of the support body. In a preferred embodiment, the lower surface of the top formation of the breaking tip, in face to face contact with and secured upon the outer surface of the top wall of the cover when the tooth formation is assembled on the support body, is complementarily provided with a plurality of planar face portions.

The flat faces facilitate mating of the two surfaces. The flat faces also facilitate replacement of the tip on an existing cover, for example in that they make it easier to remove any securing weld, and in that flat faces on the cover are easier to clean by grinding etc before application of a replacement tip.

According to another aspect of the invention there is provided a tooth construction assembly comprising a tooth construction formation as above described mounted on a support body as above described. Thus, in this more complete aspect there is provided a tooth construction assembly, for example for a mineral breaker, the tooth construction assembly including a tooth shaped support body covered by a shell on which is mounted a breaking tip formation; the support body having a front face, an opposed rear face, a pair of opposed side faces extending therebetween, and a top face; the shell being composed of a cover formation defining a front wall, opposed side walls, and a top wall overlying and seated in face to face contact with respective front, side and top faces of the support body; the breaking tip formation comprising a pick formation presenting a rear surface in face to face contact with and secured upon the front wall of the cover so as to project forwardly therefrom and a top formation extending rearwardly of the pick formation and presenting a lower surface in face to face contact with and secured upon the top wall of the cover.

According to another aspect of the invention there is provided a drum construction for a mineral breaker, the drum construction including a plurality of toothed annuli adapted to be mounted on a drive shaft of a mineral breaker drum, each annulus having a plurality of tooth construction assemblies as defined above spaced about its circumference.

Conveniently, for each tooth annulus the support bodies of each tooth construction are mounted on a common annular boss to be secured to the drive shaft, for example by welding, and further conveniently the annular boss and support bodies are formed integrally as a unitary forging.

Various aspects of the present invention are hereinafter described, with reference to the accompanying drawings, in which.

Figure 1:
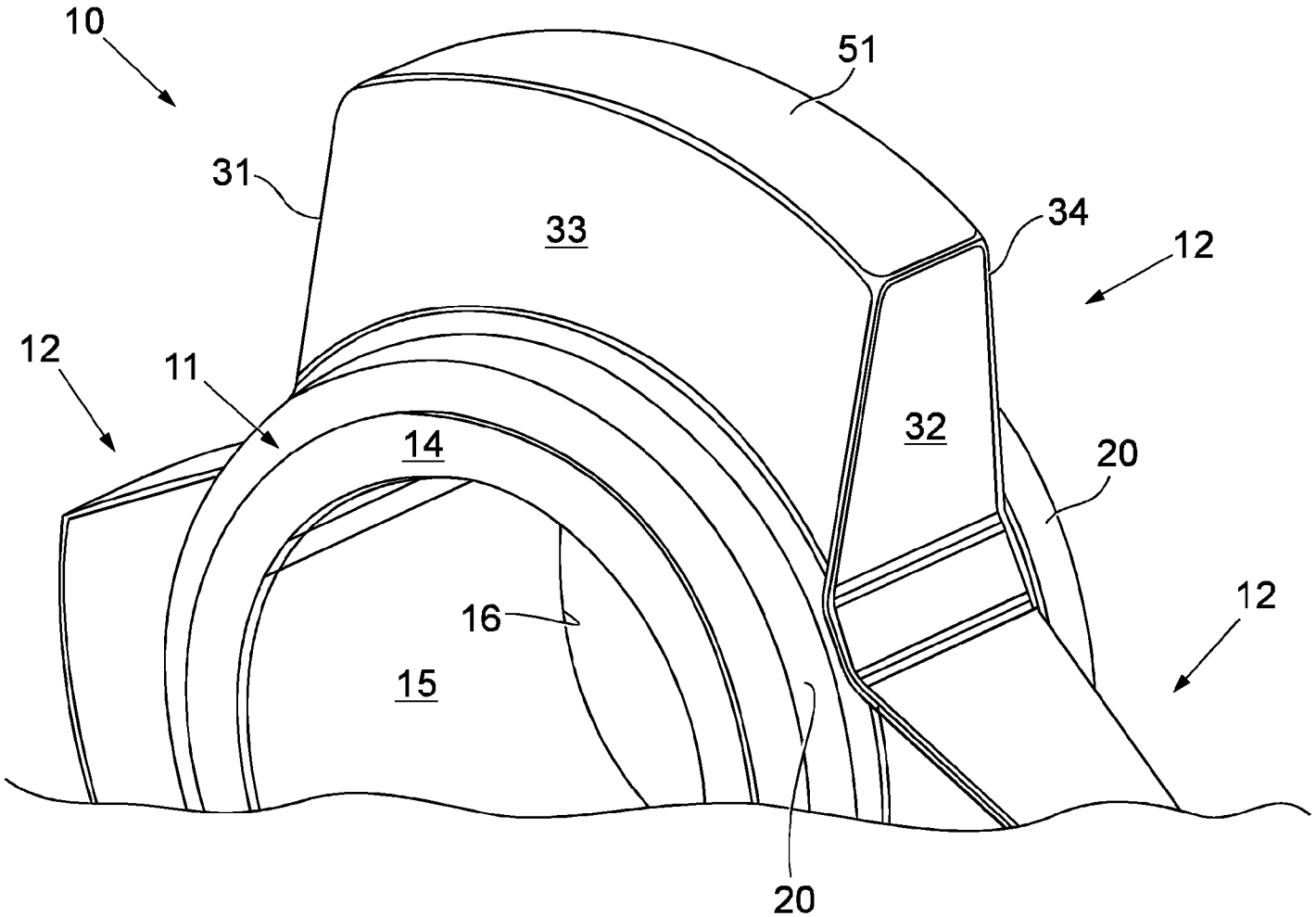
FIG. 1 is a part perspective view of a drum annulus according to an embodiment of the present invention.

Referring initially to FIG. 1, there is illustrated a drum annulus 10 having an annular boss 11 from which a plurality of tooth supports or horns 12 project radially. The annulus 10 is illustrated as having four horns 12 spaced about its circumference (one of the horns not being shown). It is envisaged that the number of horns 12 may be greater or less than four; typically the number of horns 12 would be in the range of 3 to 8.

The horns 12 have an axial extent less than the axial extent of the annular boss 11 and are centrally located relative to the axial end faces 14, 16 of the boss 11. Accordingly, on both sides of the row of horns 12 the boss 11 defines an annular shoulder 20.

The drum annulus 10 includes a through bore 15 which, in use, enables the annulus 10 to be slid onto a drive shaft. To construct a drum assembly for a mineral breaker, several drum annuli 10 are slid onto a drive shaft (not shown) and each annulus 10 is fixedly secured to the shaft so as to be rotatable therewith.

Preferably each annulus 10 is secured to the drive shaft by keyways and/or welding. If welded, the welding is conveniently achieved by exposing a portion of the shaft in between adjacent annuli and welding the annuli to the exposed portion of the shaft.

Preferably the exposed portions of the shaft are defined by axially spacing opposed end faces 14, 16 of adjacent annuli and filling the resultant gap with weld.

Preferably the annulus 10 is forged in one piece from a suitable metal such that the boss 11 and horns 12 are integrally connected.

A method of construction of a complete breaker tooth assembly is illustrated with reference to FIGS. 2 to 5, in which an integral one-piece cover having front, side and top walls is first attached to the horn 12, and an integral breaker tip including forward pick extension and rearward top extension is then attached to the front and top faces of the cover. This is in accordance with the preferred method of assembling a tooth construction in accordance with the invention. However, it should be understood that the principles of the invention are equally applicable to application of the tip to a cover which is first assembled from plural separate walls in situ, for example in the manner described in International Publication WO2005/046875.

In the illustrated embodiment, the horn 12 is first covered with the cover 60 which is preferably cast from a suitable metal. The cover 60 has a pair of opposed side walls 62, 64, a front wall 66 and a top 65. The cover 60 has an open back 67. The cover is formed integrally as a single casting.

The cover 60 defines an internal pocket which has faces which seat in face to face contact with faces 32, 33, 34 and 51 of the horn 12. A mating taper is provided between the cover 60 and the horn 12 for a better fit in the axial direction. This taper is so configured that it will tend to tighten as the inner surface of the top face 65 makes contact with the top of the horn during fitment.

The side walls 62, 64 include at least one window or aperture 68 which exposes a portion of the underlying face 33 or 34 of the horn 12. The aperture 68 has side walls 69 which are secured to the exposed face 33 or 34 of the horn 12 by welding. Preferably the entire aperture 68 is filled with weld in the assembled state.

Similarly, the front wall 66 is provided with at least one window or aperture 75 which exposes a portion of face 32. The aperture 75 has side walls 76 which are secured to the exposed portion of face 32 by welding. Preferably, the entire aperture 75 is filled with weld in the assembled state.

The rear end faces 79 of the cover 60 are secured to the horn 12 by a welded seam extending between the internal edges of faces 79 and the horn 12. In the embodiment the rear end faces 79 are co-planar with the rear face 31 of horn 12. Such an arrangement might be preferred. However, in other cases, it might be more suitable to provide an arrangement whereby the rear face 31 is recessed below, or protrudes beyond, the rear end faces 79.

Accordingly the cover 60 is securely fixed to the horn 12 by welding located at the front, both sides and rear of the cover 60.

The top wall 65 of cover 60 defines a top face portion corresponding to, and seated upon, the top face 51 of the horn 12. However, the upper faces of the cover 60 which are thereby exposed do not correspond directly in shape to the curved top face 51 of the horn 12, but instead comprise a plurality of (in this embodiment three) planar surfaces, 65*a* to 65*c*, which are angled to each other so that they generally follow the circumferential arc of the surface 51, but so that they present flat planar faces for face to face contact with complementary flat faces of a corresponding rearward extension of a tip formation (see FIG. 5). Such a configuration makes for easier mating between the cover and the tip formation.

Figure 2:
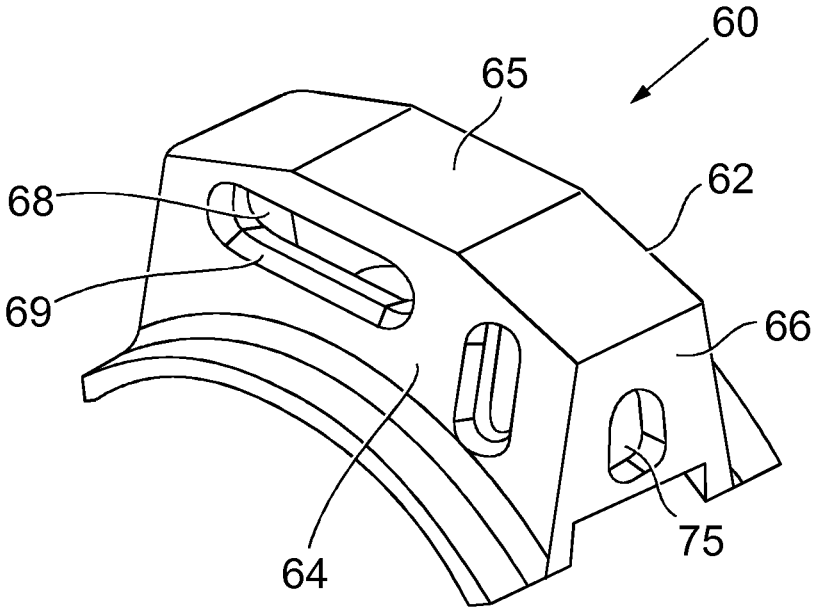
FIGS. 2 and 3 are perspective views of a cover in accordance with the invention for the drum annulus of FIG. 1, respectively from a forward and rearward view.
Figure 3:
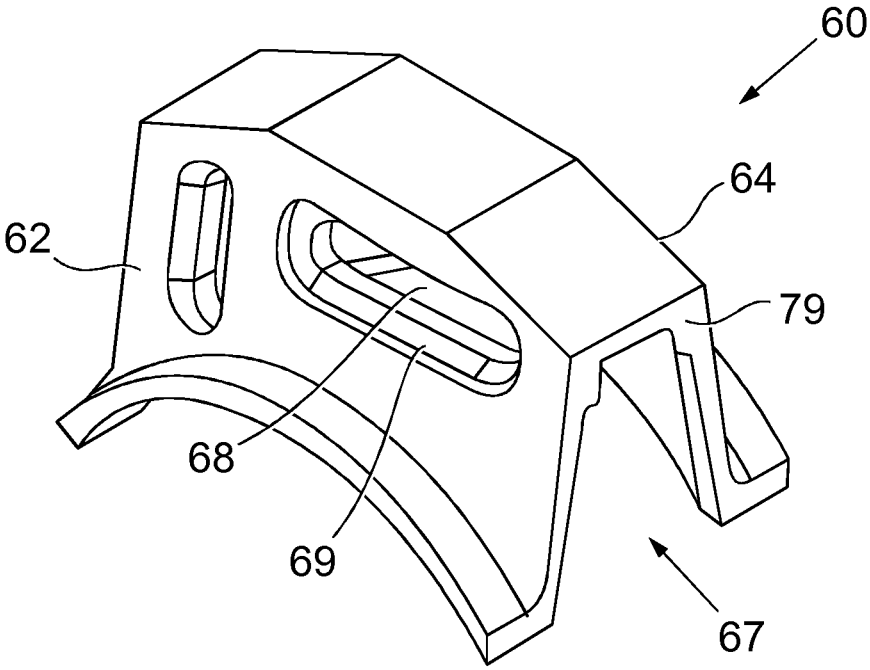
Figure 4:
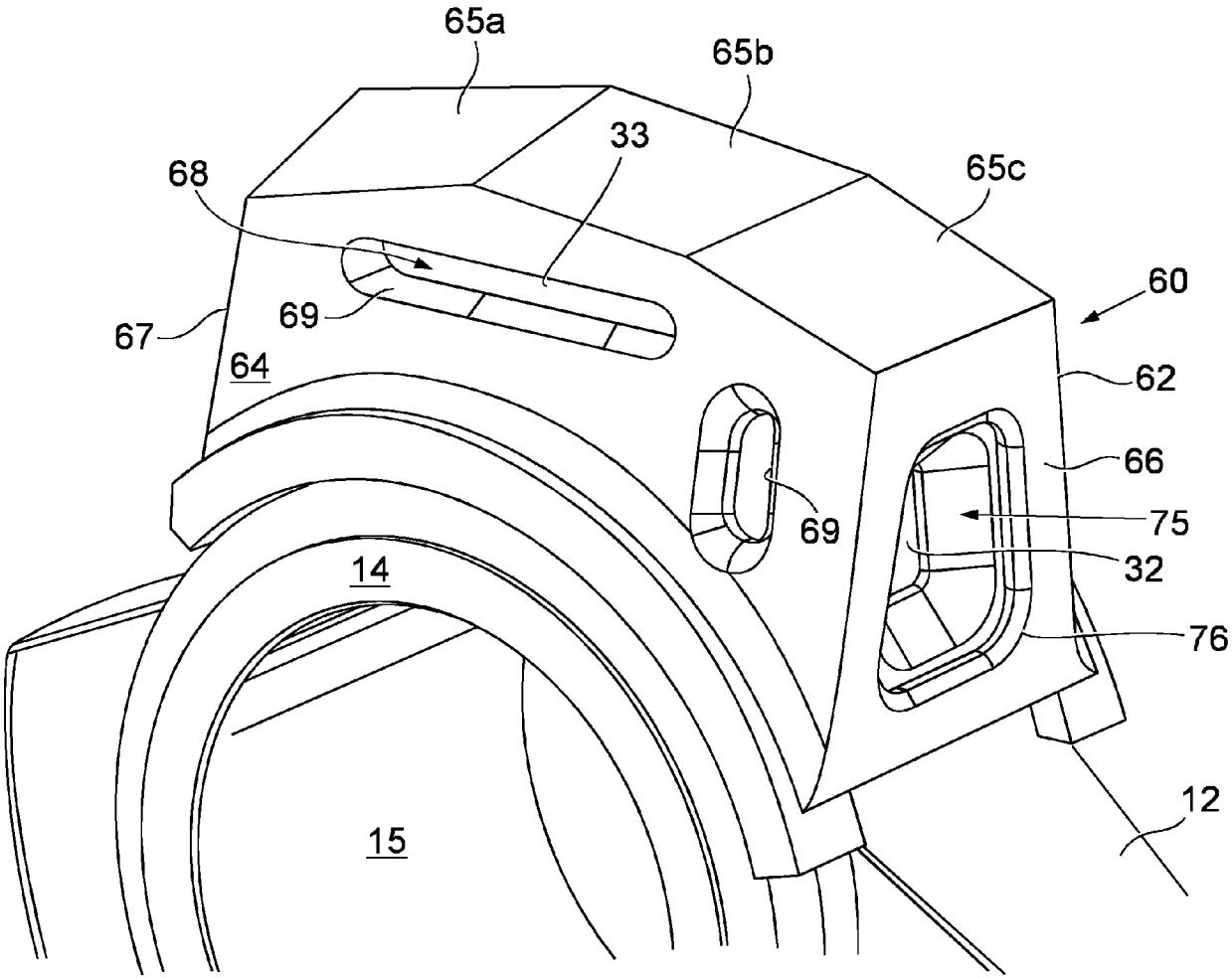
FIG. 4 is a part perspective view of the drum annulus of FIG. 1 with the cover of FIG. 2 and FIG. 3 fitted.

Thus, when assembled as illustrated in FIG. 4, the cover of FIGS. 2 and 3 is securely mounted upon the horn 12 such that internal faces of the respective side wall 62, 64, front wall 66 and top wall 65 are in secure, face to face contact with the corresponding walls 34, 33, 32, 51 of the horn 12, and are secured thereto by welding through the apertures. The cover is securely carried on the horn, and provides a mounting means for the breaking tip formation (see FIG. 5). The cover is nevertheless a consumable component which can be removed in accordance with known practice in the industry for example, by removing the welds from the sites indicated.

Figure 5:
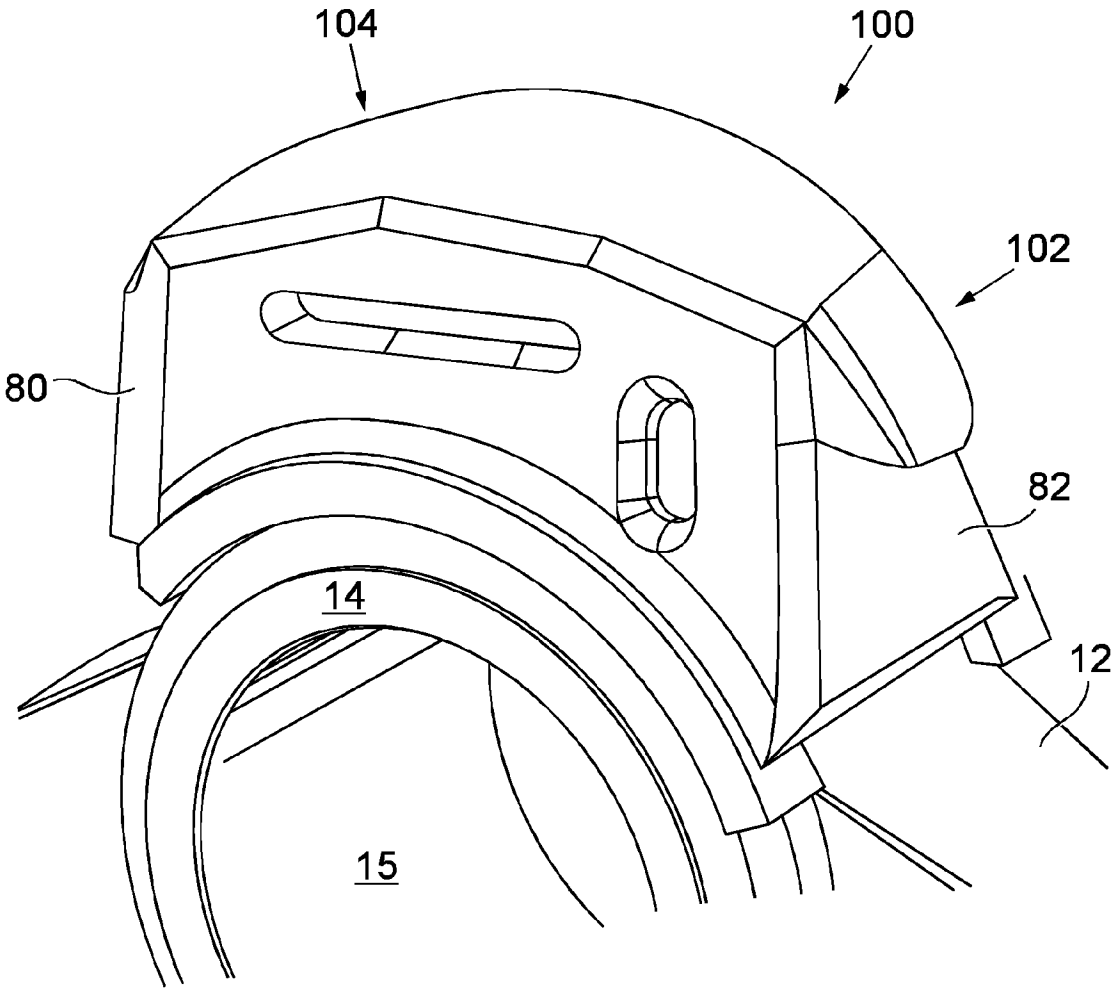
FIG. 5 is a part perspective view of the assembly of FIG. 4 with a breaking tip in accordance with the invention in position.

Attachment of a breaking tip assembly in accordance with the invention to the outer surfaces defined by the cover is illustrated in FIG. 5.

As illustrated, a breaking tip member 100 of particularly wear resistant material is fabricated as in integral whole, for example as a single casting, to comprise a forwardly extending pick portion 102 and a rearwardly extending top portion 104. This formation is illustrated in greater detail in FIG. 6 and FIG. 7.

The pick formation 102 has a rear face adapted for face to face mating with a forward face of 66 of the cover 60. The top formation 104 has a lower face adapted for similar face to face mating with the top face of the cover 65, and hence comprising three planar surfaces at angles complementary to those of the three surfaces 65*a*, 65*b*, and 65*c*, of the cover 60.

The above arrangement produces a breaker tooth in which a horn 12 of familiar construction is provided which is enclosed by a one-piece shell-like tooth cap defined by walls 62, 64, 65, 66. The tooth cap is mounted to the horn by welding to provide a very strong underlying shell-like construction which is securely fixed to the horn 12, and on which the breaking tip member 100 can be fully secured.

In the embodiment, as illustrated in FIG. 3, the cover has an open rear 67. In a convenient arrangement, the rear end faces 79 of the cover 60 may be co-planar with the rear face 31 of the horn 12. Alternatively the rear face may be recessed below, or protrude beyond, the rear face. The cover may then be secured to the horn 12 by a welded seam. This additionally secures the cover, and also provides for the optional mounting of a rear wear plate 80 which overlies the rear face 31 of the horn 12 and the end faces 79 of the cover 60. The rear plate 80 is formed of metal plate and is located in face to face contact with the rear face 31. It is preferably secured to both the cover and the horn by a suitable weld that may optionally be secured to the cover only, with the cover providing a secure mounting on the horn.

An optional forward wear plate is mounted in face to face contact with the forward face 66 of the cover 60, for example by welding. The forward wear plate 82 is formed of metal plate and protects the forward surface to the extent that is not already covered by the forwardly extending portion 102.

Both wear plates 80, 82 may be consumable components fabricated to a suitable degree of wear resistance. The wear regime experienced by the wear plates is not necessarily as severe as that experienced by the portions of the breaking tip member 100. Materials selection can be made accordingly.

The above arrangement produces a breaker tooth in which a horn 12 is provided which is completely enclosed by the walls of 62, 64, 65, 66 of the cover 60 in combination with the forward and rearward wear plates 80, 82 to define a shell-like tooth cap. This provides a very strong construction securely fixed to the horn 12. The front part of the tooth is firmly seated in fixed relationship with the horn front face when so assembled and so is highly resistant to loosening during operation as it is exposed to impacts on the front of the tooth. The rear of the tooth shell as defined by the wear plate 80 is fully seated on the rear face of the horn during assembly and fixed into position independently of the front of the tooth. This makes the rear plate 80 similarly resistant to loosening by impacts on the rear of the tooth. It follows therefore that the fabricated tooth assembly is highly resistant to loosening by repeated alternate impacts to the front and rear of the tooth such as might occur in use. The construction of breaker tooth provides a very strong breaker tooth since welding of the covers to the horn in effect adds strength to the horn.

As wear takes place in use, components can be replaced simply by removal of the worn component and insertion of a new one. Removal is easily achieved by removal of the relevant weld. In particular, the part most likely to require replacement during wear, the breaking tip formation 100, can be removed as it wears. The forward and rear plates 82, 80 are similarly replaceable. When it becomes necessary, the cover 60 may also be replaced.

Figure 6:
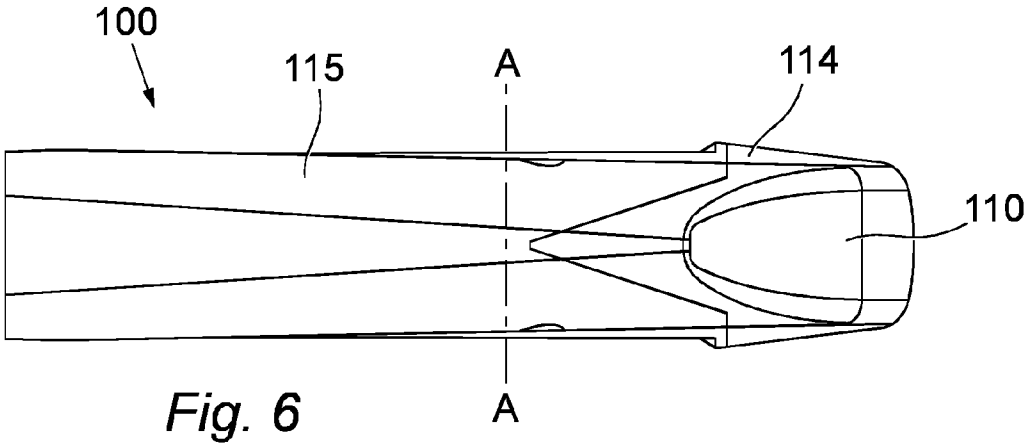
FIG. 6 and FIG. 7 illustrate, respectively in plan view and side elevation, a breaking tip in accordance with the invention.
Figure 7:
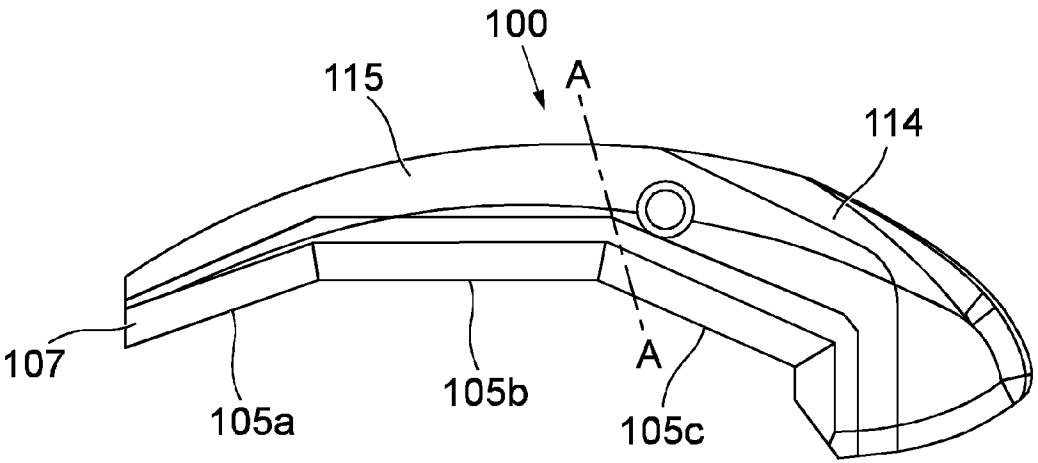

The invention is distinctly characterised by the provision of a breaking tip member 100 which includes both a forwardly projecting pick, which may be of generally conventional design, and a rearwardly projecting top portion which covers the top of the cover and presents an outward, top surface for the assembled tooth, the two elements being formed most preferably as an integral whole, and as a single replaceable portion experiencing the greatest wear in use. A particularly preferred arrangement for the breaking tip member 100 is illustrated in FIGS. 6 and 7.

It can be seen that in this preferred arrangement the angle of the axis of the tip is tangential to a circumferential arc scribed through its frontward most portion and is provided with a partially planar forward face 110. This means that the majority of the impact loads are directed in the line of the tip axis and hence load the tip-securing welds primarily in shear only. This can be contrasted with the purely conical structures in the prior art in which a tip axis angle is created that points outside this scribed circle passing through the tip, providing a more opened-mouth angle of attack on the mineral, and tending to cause tensional loads which might lead to a tooth breaking off in contact with harder materials. Additionally, the angle of the new tip described above reduces the amount of radially unbalanced loading which can increase bearing and shaft life during use. Advantages embodying the same principle could be obtained by an axis which extends more radially outward or more radially inward of the circumferential arc but which still avoids this drawback of prior art conical structures, in particular if the axis of the tip approximates to tangential to the circumferential arc scribed through its frontward most portion, for example being more radially outward or more radially inward by no more than 20 degrees.

In the illustrated embodiment, the tip formation is additionally protected by two grades 114, 115 of applied hard facing. Alternatively a single uniform gradation of hard facing could be applied.

In the illustrated embodiment, the tip formation is integrally formed as a one-piece monolith. Alternative constructions could be envisaged. In particular, to accommodate different wear rates at the forwardly projecting pick and rearwardly projecting top portion these components may be separately fabricated, for example to different material grades, the tip formation being formed as a two-piece construction. A possible point of division between a pick and top portion is represented by the line A-A on FIGS. 6 and 7. In such an alternative embodiment, the pick and top portion may be formed separately, for example as separate castings, and welded together.

Lower surfaces of the tip formation 105*a*, 105*b*, 105*c* complementarily engage with the corresponding planar surfaces 65*a*, 65*b*, 65*c* of the cover as above described. A welded joint is made between the tip formation 100 and the cover along the edges 107. In a preferred arrangement, the bottom faces of the formation 100 are provided with a recess, for example along a midline, to provide a small gap which assists removal, by allowing a person to chase the gap, when removing a worn tip by removing the welds.

This means that the tooth construction of the present invention can transmit relatively high forces for breakage of very hard minerals with a reduced risk of snapping and in addition with less risk of the tooth shell or cover working loose.

The strength of the tooth construction according to the invention is also enhanced by the fact that the horn is solid, i.e. does not contain through bores as is commonly required with prior art constructions.

In order to assemble a drum construction for a mineral breaker, it is preferably envisaged that a plurality of tooth annuli 10 are slid onto a drive shaft and are spaced axially apart along the shaft and at desired rotary positions relative to one another. Spacing adjacent annuli 10 apart defines an annular channel extending circumferentially about the shaft wherein the bottom of the channel is defined by an exposed circumferential portion of the shaft and opposed sides of the channel are defined by opposed axial end faces 14, 16 of adjacent annuli bosses 11. The adjacent annuli 10 are then secured in position by welding the end faces 14, 16 to the exposed circumferential portion of the drive shaft, preferably by filling the defined channel with weld.

Once the annuli 10 have been secured to the drive shaft, the breaker teeth are then constructed in situ.

The invention claimed is:

1. A tooth construction for a mineral breaker, the tooth construction comprising:

a shell that is mountable upon a tooth shaped support body and a breaking tip formation mountable on the shell which together define generally an outer shape of the tooth construction;

the support body having a front face, an opposed rear face, a pair of opposed side faces extending therebetween, and a top face;

the shell being composed of a cover formation defining a front wall, opposed side walls, and a top wall overlying and configured to be seated in use in face to face contact with respective front, side and top faces of the support body;

the breaking tip formation comprising a pick formation presenting a rear surface configured to be seated in use in face to face contact with the front wall of the cover so as to project forwardly therefrom and a top formation extending rearwardly of the pick formation and presenting a lower surface configured to be seated in use in face to face contact with the top wall of the cover; and wherein the top formation of the breaking tip formation extends over the top wall of the cover formation for at least a substantial portion of a length and a width of the top wall.

2. The tooth construction in accordance with claim 1 wherein the breaking tip formation includes an integrally formed pick formation and rearwardly extending top formation.

3. The tooth construction in accordance with claim 2 wherein the breaking tip formation is integrally formed as a one-piece casting.

4. The tooth construction in accordance with claim 1 wherein the breaking tip formation includes a pick formation and rearwardly extending top formation which are separately formed and joined together.

5. The tooth construction in accordance with claim 4 wherein each of the pick formation and the extending top formation is integrally formed as a one-piece casting.

6. The tooth construction in accordance with claim 1 wherein the cover formation comprises a plurality of cover elements comprising at least separate front and top covers and paired side covers which are fixedly securable to one another and/or to the support body in use by welding to define the said front wall, opposed side walls, and a top wall of a shell cover or cap for a unitary tooth construction.

7. The tooth construction in accordance with claim 1 wherein the shell comprises a cover formation integrally including, the said front wall, opposed side walls, and a top wall.

8. The tooth construction in accordance with claim 7 wherein the side and front walls each have at least one aperture formed therein to expose an underlying corresponding face of the support body when mounted thereon.

9. The tooth construction in accordance with claim 7 wherein rear end faces of the opposed side walls of the cover are mounted on and securable to the rear face of a horn by welding, and wherein a rear wear plate is additionally provided to overlie a rear face of the horn and the said end faces of the cover.

10. The tooth construction in accordance with claim 1 wherein a forward wear plate is provided to be mounted to at least one of the front wall of the cover and the front face of the support body to an extent that the front wall is not already covered by the pick formation of the breaking tip.

11. The tooth construction in accordance with claim 1 wherein a top surface of the cover lying outermost when assembled comprises a plurality of planar surface portions, and the lower surface of the top formation of the breaking tip, in face to face contact with an outer surface is complementarily provided with a plurality of planar face portions.

12. The tooth construction in accordance with claim 1 wherein the breaking tip formation is mounted upon the top and front walls of the cover formation and secured thereto by welding.

13. The tooth construction in accordance with claim 1 wherein an angle of an axis of the tip of the pick formation is tangential to a circumferential arc scribed through its frontward most portion and the pick formation is provided with a partially planar forward face.

14. The tooth construction in accordance with claim 1 wherein the walls of the cover formation are fixedly secured to the respective walls of the support body by welding.

15. The tooth construction in accordance with claim 1 wherein a mating taper is provided in an axial direction between the cover formation and the support body.

16. A mineral breaker comprising:

a drum comprising a plurality of teeth formed on a surface of the drum, each tooth of the plurality of teeth comprising a tooth construction in accordance with claim 1.

17. A drum construction for a mineral breaker, the drum construction including a plurality of toothed annuli mountable on a drive shaft, each annulus having a plurality of tooth construction according to claim 1 spaced about a circumference of the annulus.

18. The drum construction according to claim 17 wherein for each tooth annulus the support bodies of each tooth construction are mounted on a common annular boss secured to the drive shaft.

19. The drum construction according to claim 18 wherein for each tooth annulus, the annular boss and support bodies are formed integrally as a unitary forging.

20. The drum construction according to claim 18 wherein for each tooth annulus the support bodies of each tooth construction are mounted on a common annular boss secured to the drive shaft by welding.

21. The tooth construction in accordance with claim 7, wherein the cover formation is a unitary casting.

* * * * *